US006712235B2

(12) United States Patent
Granger

(10) Patent No.: US 6,712,235 B2
(45) Date of Patent: Mar. 30, 2004

(54) APPARATUS FOR DISPENSING A WIPING MATERIAL

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 10/376,117

(22) Filed: Feb. 28, 2003

(65) Prior Publication Data

US 2003/0140753 A1 Jul. 31, 2003

Related U.S. Application Data

(62) Division of application No. 09/700,897, filed as application No. PCT/FR99/00782 on Apr. 6, 1999, now Pat. No. 6,550, 714.

(30) Foreign Application Priority Data

May 25, 1998 (FR) ..... 98 06702

(51) Int. Cl.[7] ..... B65H 1/00
(52) U.S. Cl. ..... 221/33; 221/45
(58) Field of Search ..... 221/33, 45, 63; 242/564.4, 564.1; 83/646

(56) References Cited

U.S. PATENT DOCUMENTS 5,868,275 A * 2/1999 Moody ..... 221/33

FOREIGN PATENT DOCUMENTS

| | | |
|---|---|---|
| FR | 2643808 | 9/1990 |
| WO | 96 24281 | 8/1996 |
| WO | 97 24970 | 7/1997 |

* cited by examiner

*Primary Examiner*—Kenneth W. Noland
(74) *Attorney, Agent, or Firm*—Burr & Brown

(57) ABSTRACT

Apparatus for dispensing a wiping material of the type comprising a housing, a cover, a drum, a cutter device built into the drum, and drum cocking and returning means incorporating, arranged on a lateral side of the drum, a crank and a cocking spring, the side plates being constructed to support the reel holder, is noteworthy in that it comprises an anti-looping device for preventing looping of the material coming from the reel (B) of material including at least on mechanism acting on the reel holder to lock it in position, this mechanism being arranged ton one of the side plates of the housing, and being actuated by a flyweight device built into the movement of the rotating drum and either causing or not causing the reel holder lock to be operated in the case of application of a large force and traction on the strip of material.

4 Claims, 5 Drawing Sheets

1
2
3
4
5
6
7
8
10a
12
13
13b
21
22
23
25
26
26a
26c
27
28
29
30
31
32
33
34
34c
36
B

APPARATUS FOR DISPENSING A WIPING MATERIAL

This application is a division of U.S. application Ser. No. 09/700,897, filed Nov. 20, 2000, now U.S. Pat. No. 6,550, 714, which was the National Stage of International Application No. PCT/FR99/00782 having an international filing date of Apr. 6, 1999. The entirety of U.S. 09/700,897 is incorporated herein by reference.

FIELD OF THE INVENTION

The invention relates to the technical field of apparatuses for dispensing paper wipes made of cellulose wadding, creped paper, or suchlike material, intended more particularly for wiping the hands of users, to the dispensing of toilet paper, and to the dispensing of paper towels. The pieces of paper may be in folded or unfolded form.

BACKGROUND OF THE INVENTION

The Applicant has developed many patents on apparatuses of the above type in automatic and semiautomatic versions, and dispensing of strips of paper taken from a loading reel.

The main components of such an apparatus will be briefly recalled. An apparatus for dispensing wiping material numbered as a whole by (1) comprises a housing (2), a cover (3), a drum (4), a cutter device (5-6) built into the drum an drum cocking and returning means incorporating a crank (7) and a spring (8). In its upper part, the housing is fitted with side plates **(2*a*) capable of receiving the reel holder (9) of a reel of wiping material (B). These side plates may be of fixed positions, in which case the reel of wiping material is suspended above the drum. Alternately, the side plates or arms of a reel holder (9)** are jointed and mounted on the housing in such a way that the reel of wiping material comes into contact with the drum itself.

Such arrangements are very common in this sort of apparatus. The way the user pulls on the strip of paper can vary greatly with a larger or smaller force, to say nothing of the direction of the pull which can be an additional factor in the operation of the dispensing apparatus. Loops can then appear between the reel of wiping material and the drum involving a length of some centimeters of the strip.

In order to remedy this problem, the Applicant has developed anti-looping devices, notably in patent FR 2,643,808. These anti-looping devices make use of rotating lever assemblies mounted with respect to the reel holder and able to produce a pivoting action in order to reduce or compensate for the looping phenomenon and tension the strip of material. Such assemblies work very satisfactorily but tend to interfere with the loading of the apparatus, being face and in the front plane of the reel of material.

There is also another problem with the cost of the molds necessary for producing the anti-looping device. Despite all the precautions, it is also possible for several strips of material to be dispensed.

SUMMARY OF THE INVENTION

The object according to the invention was therefore to remedy these problems by proposing a better solution that would not inconvenience the user when assembling and loading the apparatus.

In accordance with another object of the invention, the Applicant has adopted a technical concept which can, in its principle, be used both for apparatuses in which the loading reel is suspended on the supporting side plates, or the reel rests on the drum by virtue of the pivoting of a reel holder with jointed arms or side plates.

In accordance with a first characteristic, the apparatus for dispensing a wiping material, of the type comprising a housing, a cover, a drum, a cutter device built into the drum, and drum cocking and returning means incorporating, arranged on a lateral side of the drum, a crank and a cocking spring, the side plates being constructed to support the reel holder, is noteworthy in that it comprises an anti-looping device for preventing looping of the material coming from the reel of material including at least one mechanism acting on the reel holder to lock it in position, this mechanism being arranged on one of the side plates of the housing, and being actuated by a flyweight device built into the movement of the rotating drum and either causing or not causing the reel holder lock to be operated in the case of application of a large tensile force on the strip of material.

These features and others also will become clear in the remainder of the description.

BRIEF DESCRIPTION OF THE DRAWINGS

In order to provide a clear idea of the subject of the invention, illustrated in a non-restrictive manner in the figures of the drawings in which.

Figure 1:
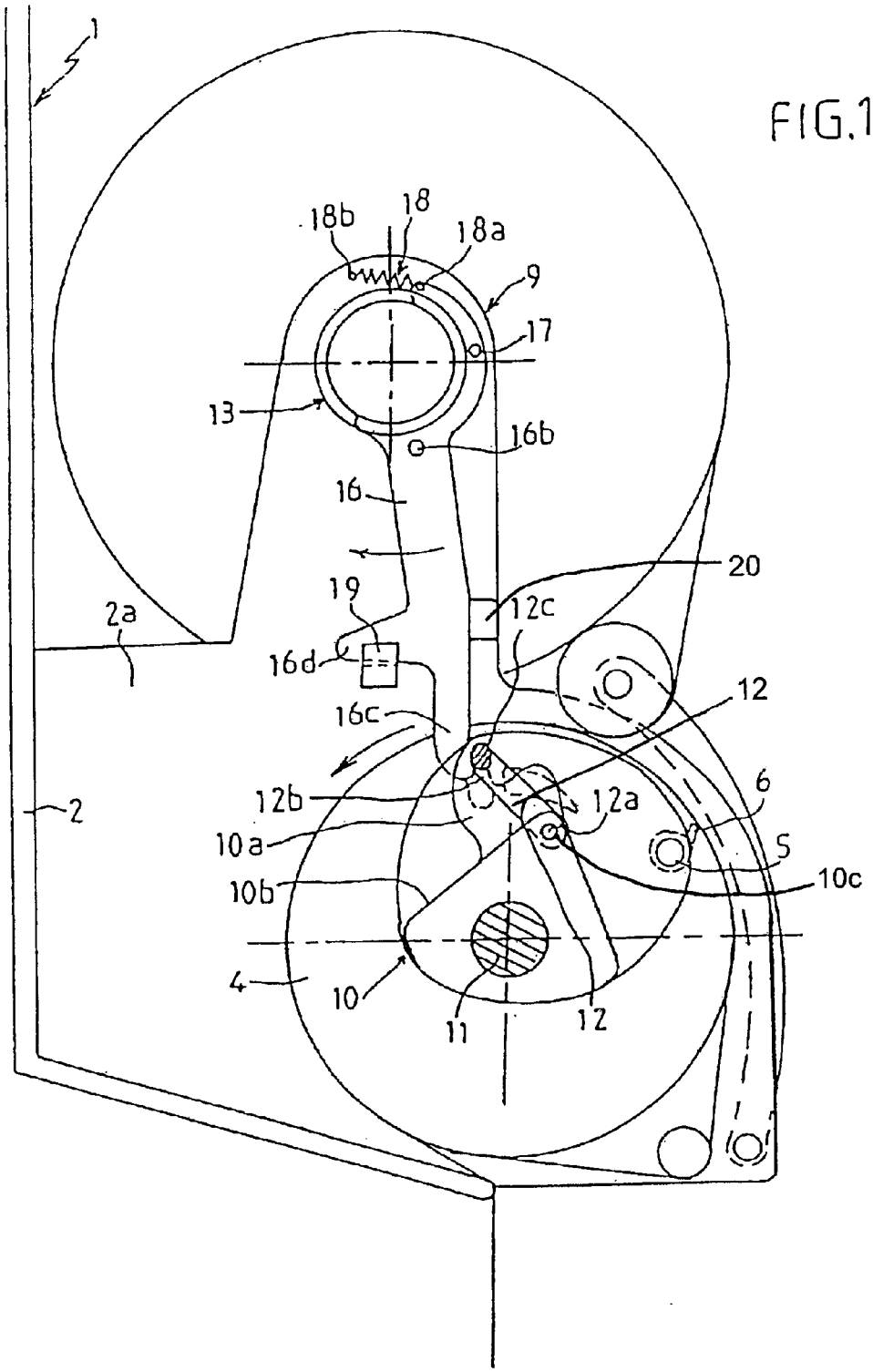
FIG. 1 is a side view of an apparatus for dispensing a wiping material illustrating a first embodiment of the anti-looping device for a reel of wiping material suspended on fixed side plates of the reel holder.
Figure 3:
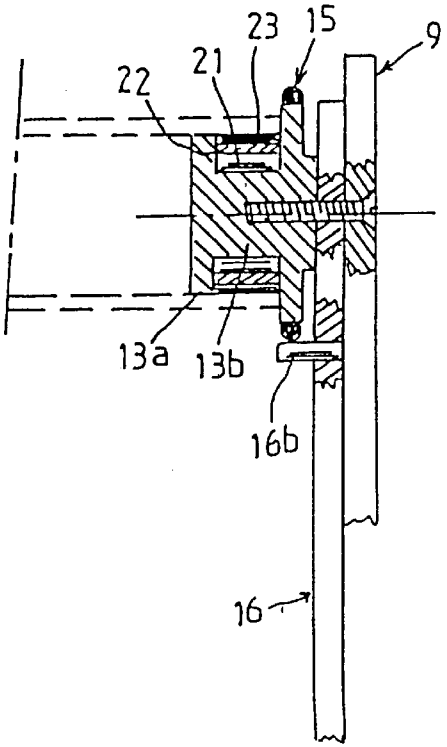
FIG. 3 is a partial sectional view illustrating the anti-looping mechanism inserted on the right side plate of the apparatus.
Figure 4:
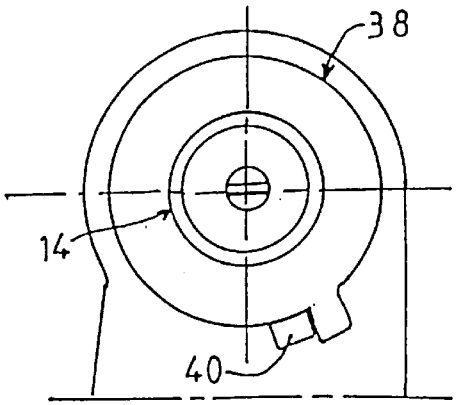
FIG. 4 is a front view indicated by the line A—A in FIG. 2 illustrating the limiting of the rotation of the anti-looping device on the left side plate.

In order to render the subject of the invention more concrete, it will now be described in a non-restrictive manner illustrated in the figures of the drawings.

DETAILED DESCRIPTION

The dispensing apparatus numbered (1) as a whole is constructed with an anti-looping device for preventing looping of the material coming from the reel of material, this device including at least one first mechanism acting on the reel holder to lock it in position, the said first mechanism being constructed so as to be arranged on a first side plate of the dispensing apparatus. This applies both to apparatuses having the reel of material suspended on a fixed side plate, and the reel resting on the drum, the arms of a jointed support reel holder.

According to the invention, the end pieces integral with the fixed side plate or plates or arms of a jointed reel holder are thus given specific shapes forming the regions of attachment of complementary means on the mechanisms in question that can be actuated.

In practice, certain components complementary to the dispensing apparatus must be identified in each of its versions, the fixed side plate version or the jointed reel holder version in which the mechanisms of the device of the invention are employed.

The drum (4) is of the type comprising a means whose lateral ends form side plate by which the cutter blade holder is supported. One of the side plates is in practice constructed with an ovoid lamina (10) provided with a profiled opening (10*a*) while a second inner lamina (10*b*) also formed integrally with the sleeve (11) supporting the side plate (10) has an opening (0*c*) for the insertion of a supporting pin (12*a*) of a hinged flyweight (12). The said flyweight thus has a dowel (12*b*) forming a hinge pin, and an outwardly projecting protrusion (12*c*) able to pass through the opening (l0*a*) formed in the ovoid lamina (10). The projecting end (12*c*) of the flyweight (12) thus comes more or less adjacent to the inside face of the side plate of the housing. The flyweight pivots freely and is hinged by gravity when the drum (4) and therefore its end side plates rotate.

According to the invention, the anti-looping device that acts on the reel holder mounted on the fixed side plate is devised by the following arrangement:

The reel holder side plate (2*a*) is constructed so as to take a revolving end piece (13) which can be fitted into the core (14) of the reel of material. This end piece (13) possesses a cylindrical supporting surface (13*a*) fitted inside the core and is extended by a disk (15) provided with a multitude of regularly spaced projections fr teeth (15*a*) around its periphery. Mounted between the side plate (2*a*) of the housing and the disk (15) of the end piece is a lever (16) of great length whose upper end (16*a*) forming a head pivots on a connecting pin (17) integral with the side plate (2*a*) of the housing, and whose position can be made closer for the locking function. The upper end (16*a*) of the lever provides attachment for one end (18*a*) of a return spring (18) whose other end (18*b*) is integral with the side plate of the housing. The return spring (18) is not under tension as long as the lever (16) is not being pushed. This lever is also provided with a projecting dowel (16*b*) situated adjacent on the notched disk. The bottom end (16*c*) of the lever (16) is provided with an end situated adjacent to the side plate of the drum supporting the abovementioned flyweight (12). In addition, the lever (16) comprises, near its bottom end, an inner hooked shape (16*d*) that is able to be guided and held in position by a fixed lug (19) integral with the inside face (2*a*) of the side plate of the housing, limiting the lateral pivoting of the lever. In addition and in opposition to this lug, a projecting stop (20) is able to restrain the lever (16) in the other direction, thus acting as a travel limiter.

As an adjunct, the end piece (13) that takes the core of the reel of wiping material can be constructed with a peripheral central recess (13*b*) forming a housing able to take rolling-contact means (21) of needle type held in place by semicircular half-shells (22) A band or belt (23) encloses the whole and serves as a supporting plane for the reel.

In this embodiment the device works in the following matter. When the operator pulls the strip of material with too great a force, there may be insufficient time for the flyweight (12) to pivot in its housing in order to pass underneath the end of the lever (16). In this situation the said flyweight (12), being carried along by the speed of rotation of the abovementioned lever (16). On contacting the lever it turns it, against the action of its spring (18) connected to the top end or head. Also, the projecting dowel (16*b*) is also pivoted and enters the adjacent space between two consecutive teeth (15*a*) of the notched disk. This engagement therefore locks the reel holder in position. In addition, the belt (23) mounted on the end piece (13) provides an extra braking action on the reel core.

As a variant, the disk (15) may be produced in the form of a polygonal section against which the abovementioned dowel (16*b*) presses successively. Other configurations of the disk (15) may be engaged in order to produce the action of contact, pressure and locking of the lever.

The return to level occurs automatically by the returning of the drum by the return spring of the crank and the winding back of the material onto the reel holder.

Reference will now be made to the second embodiment illustrated in FIGS. 5 to 8. As in the prior art, the reel holder support (25) is constructed in a U shape in which the side arms (25*a*) are fitted with an end piece (13) that can fit into the reel core. One of the arms (25*a*) of this reel holder support may itself be on a pivoting mounting in order to facilitate loading of the apparatus. Elastic means for returning and tensioning this reel holder support allow contact and pressure between the reel and the drum.

The anti-looping device is thus constructed as follows.

The end piece (13) that fits into the core is made as described earlier, so the same references will be used.

The drum is constructed in a similar way with, near one of its side plates, a flyweight (12) for preventing reverse rotation of the drum.

In this embodiment the anti-looping mechanism is as follows.

A first lever (26) is situated from the rear wall of the housing and pivots on a pin (27) that runs into the adjacent side plate of the housing and on an inner lug (28) which provides the hinge point for the reel holder support via a bracket (29) and a connecting pin (30). The reel holder arm is advantageously U-shaped to enable it to accommodate in its interior a parallelepipedal block (31) that can slide inside the reel holder arm. The blind face of the reel holder arm contains an obliquely oriented elongate slot (32) that will allow a projecting dowel (33) on the abovementioned block (31) to move and slide between an upper position and a lower position. This block (31) is integral with an L-shaped second lever (34) whose upper leg (34*a*) is attached to the block (31) and whose lower leg (34*b*) is mounted on the pivot pin of the reel holder support. The end (34*b*) of the second lever contains an elongate indentation (34*c*) in which the said pin (30) slides so that the position of the second lever (34) and hence of the block (31) attached to the latter can be varied. The lug (28) molded in the housing is located between the bottom end of the said second lever (34) and the region (26*a*) of pivoting and attachment of the first lever (26). The lug (28) thus has a through opening (28*a*) for the pin connected to the first lever (26) and a second through opening (28*b*) for the pin connected to the second lever (34) and the hinge base of the reel support arm. A return spring (36) is provided between the first lever (26) with a point of attachment and the second lever (34) at its angled part (34*d*).

Positioning is therefore as follows.

When not under pressure, that is when the drum of the apparatus is turning normally and the flyweight is returning to its normal position, there is no action on the first lever. The reel holder can rotate normally.

In the event of sudden application of pressure by too strong a tug from the user, the flyweight (12) connected to the drum is no longer able to return to its initial place. It therefore strikes the free end (26*c*) of the first lever (26), causing it to pivot and rotate. This pivoting will place the free end of the first lever in contact with the lower face of the second lever (34), imparting to it a movement of upward displacement along the reel holder arm. This movement will displace the dowel (33) attached to the block (31) and result in its positioning itself between two consecutive teeth (15*a*) of the notched circular lamina (15) of the end piece. There will likewise be locking of the end piece so that the reel cannot turn. The freeing of the lever (26) by the flyweight happens automatically under the same circumstances as indicated earlier.

Figure 2:
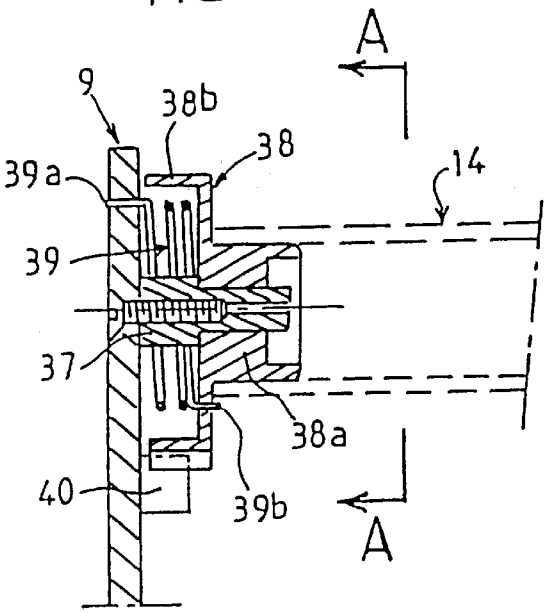
FIG. 2 is a partial sectional view illustrating an anti-looping mechanism inserted on the left side plate of the apparatus.
Figure 6:
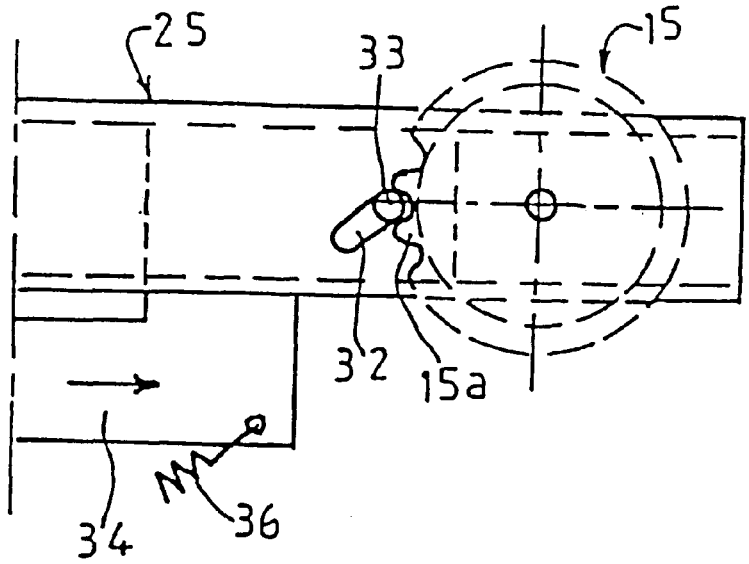
FIGS. 5 and 6 are diagrammatic views illustrating the blocking of the reel holder in position from the right side plate.
Figure 5:
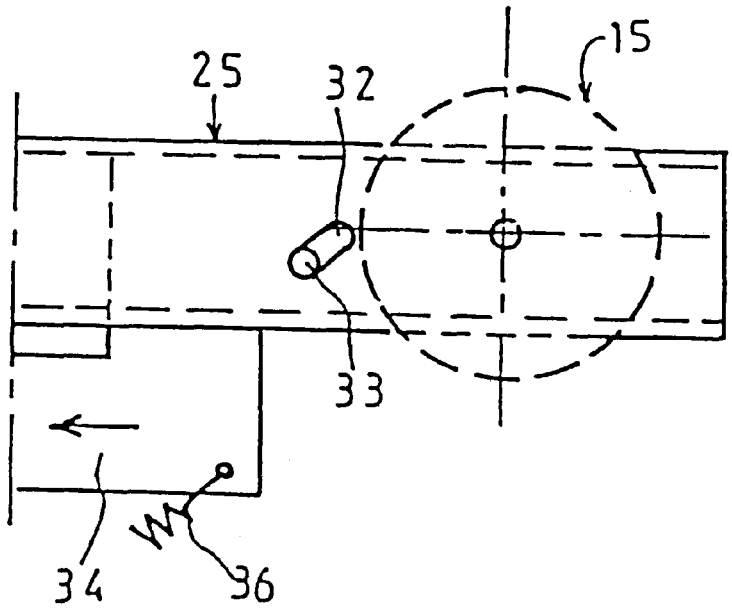
Figure 7:
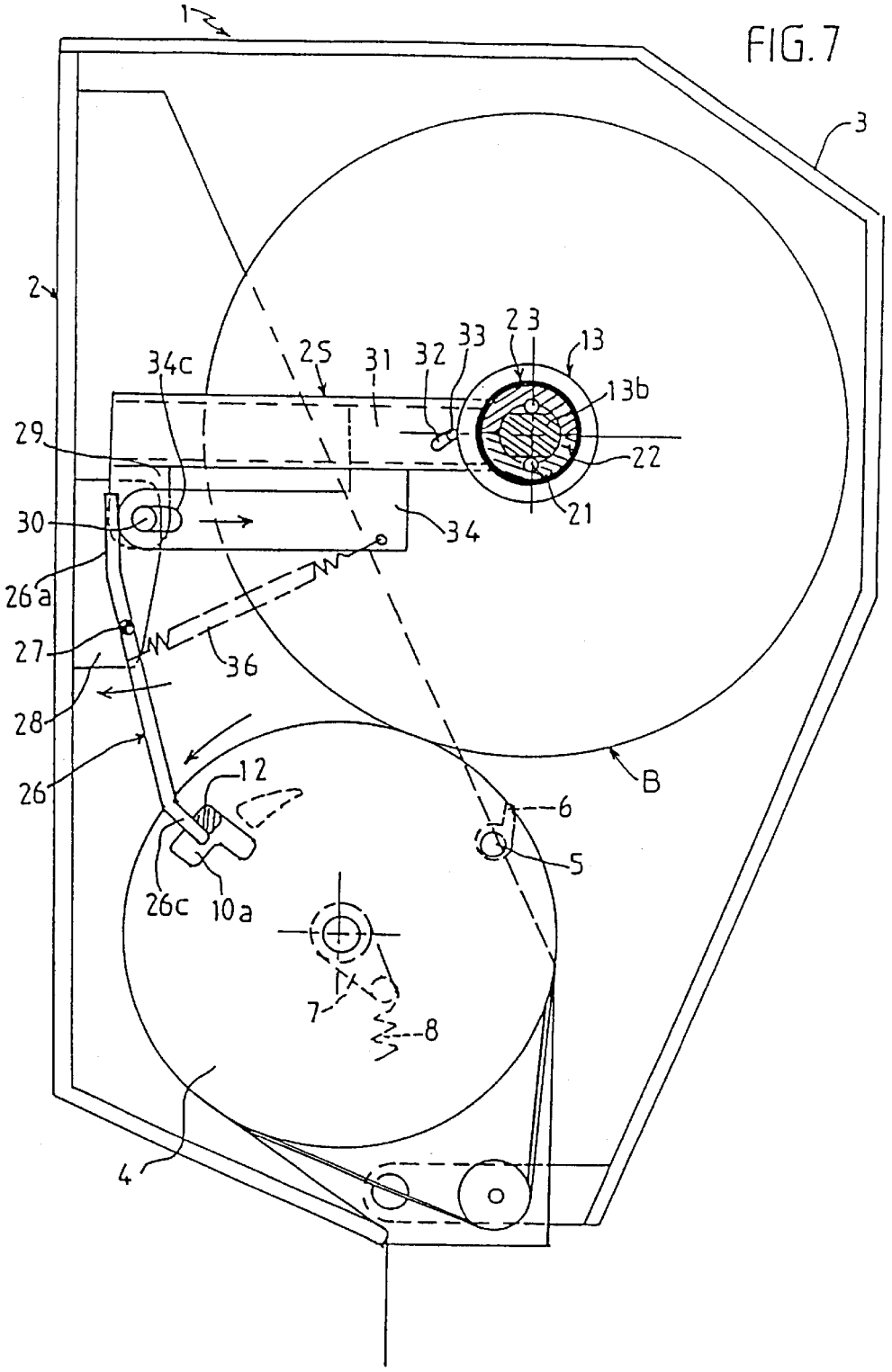
FIG. 7 is a side view of the dispensing apparatus according to the invention in a second embodiment in which the reel holder supporting side plate is jointed to allow the reel to rest on the drum.
Figure 8:
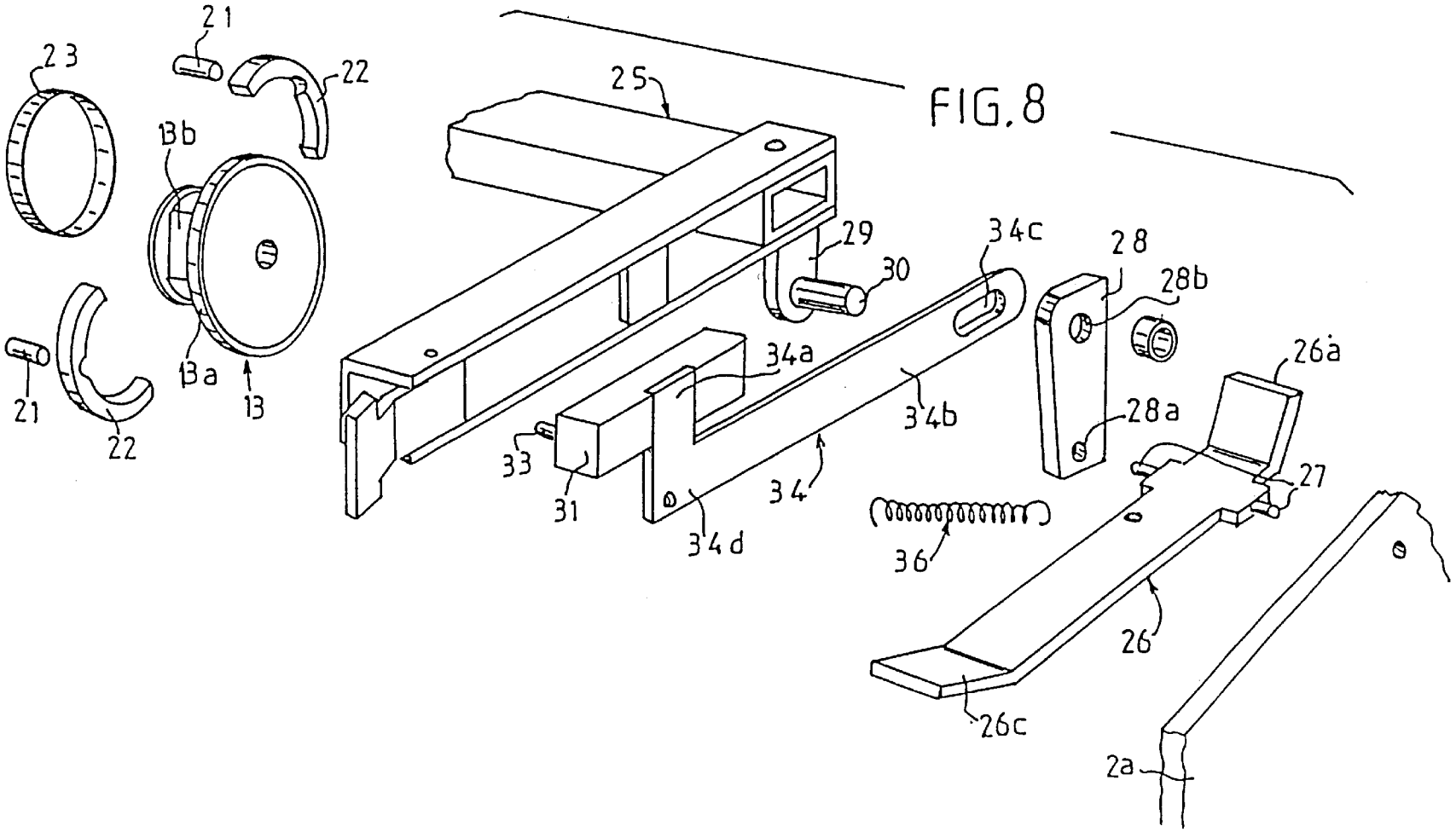
FIG. 8 is an exploded perspective view of the anti-looping device that fits on the right side plate of the apparatus.

Reference should now be made to FIG. 2 of the drawings in which the second reel holder side plate is itself fitted with a complementary means for turning the reel backwards.

In this complementary embodiment whose aim is to have the reel turned backwards in order to rewind the reel in the event that a loop develops, the mechanism comprises the following arrangements.

The side plate, in the fixed version, is fitted with a central hub (37) secured by a screw or other means. This hub (37) is shouldered and takes on its end a hat-like end piece (38) with an outward supporting surface (38*a*) that takes the core of the reel and a cover shape (38*b*) surrounding the above-mentioned hub. A spiral spring (39) is arranged in the resulting housing with one end (39*a*) fixed to the side plate and the other end (39*b*) fixed to the cover. The rotation of the reel when the paper is pulled by the user will cause the reel holder means to turn in one direction, tightening the spring and storing energy. This tension is maintained for as long as the free end of the strip of paper is held. The release of the paper produces elastic relaxation causing the strip of material to retreat, thereby eliminating any looping thereof that may have occurred. A stop (40) limits the travel and rotation of the end piece (38).

An apparatus for dispensing a strip of wiping material can therefore be provided with the various mechanisms to avoid the looping effects referred to.

What is claimed is:

1. A wiping paper dispensing apparatus comprising:

a housing;

a cover;

a drum disposed in a lower part of said housing and supported therein for rotation;

a cutter device built into the drum; and drum cocking and returning means arranged on a lateral side of the drum, said cocking and returning means including a crank and a cocking spring;

side plates in an upper part of said housing, said side plates being constructed to support a reel holder therebetween; and an anti-looping device for preventing looping of a strip of material extending from a reel (B) of wiping paper material retained on said reel holder, said anti-looping device including at least one mechanism acting on the reel holder to lock it in position, said mechanism being arranged on one of the side plates of the housing, and actuated by a flyweight device built into the movement of the rotating drum for causing the reel holder to be locked upon the application of a large tensile force on the extending strip of wiping paper material, wherein the reel holder support includes a pair of spaced reel holder arms, each of said reel holder arms being fitted with an end piece that fits into the core of a supported reel of wiping paper material supported thereon, and in that one of the reel holder arms is fitted with means that are able to move in order to be acted upon by the flyweight of the drum and lock the reel holder end piece in position.

2. Apparatus for dispensing a wiping material according to claim 1, further including:

a first lever situated from the rear wall of the housing in which said first lever pivots on a pin extending to one of the side plates of the housing, wherein the reel holder arm fitted with said end piece locking means accommodates a parallelepipedal sliding block in its interior, said sliding block having a projecting dowel that is able to act or not act on the rel holder end piece and an associated notched disk, said sliding block being integral with a second lever having an upper leg attached to the sliding block and a lower leg that is mounted on a pivot pin of the reel holder support, the end of the said second lever allowing sliding of the pin in order to vary the position of the second lever and the sliding block, under the action of the flyweight in pressure contact with the second lever, causing the latter to turn.

3. Apparatus for dispensing a wiping material according to claim 2, further including:

a lamina connecting the bottom leg of the second lever to the region of attachment of the first lever, said lamina having a through opening for the pin connected to the first lever and a second through opening for the pin connected to the second lever and the hinge base of the reel holder arm; and a return spring connecting the first and second levers.

4. Apparatus for dispensing a wiping material according to claim 1, wherein one of the side plates is fitted with a shouldered central hub that takes on its end a hat-shaped end piece having an outward supporting surface that receives the core of the reel and a cover shape surrounding said central hub, said apparatus further including:

a spiral spring arranged in the housing, said spring having one end fixed to a side plate and the other end fixed to the cover, wherein rotation of the reel when the paper is pulled by the user, will cause the reel holder means to turn in one direction, tightening the spiral spring and storing energy, this tension being maintained for as long as a free end of the strip of paper material is held, and in that the release of the strip of paper material produces elastic relaxation causing the strip of paper material to retreat, thereby eliminating any looping thereof that may have occurred; and a stop limiting the travel and rotation of the end piece.

* * * * *